United States Patent [19]

Hansen

[11] Patent Number: 5,073,322

[45] Date of Patent: Dec. 17, 1991

[54] PROCESSING OF ETHYLENE TEREPHTHALATE/HEXAHYDROTEREPHTHALATE COPOLYMER FILAMENTS

[75] Inventor: Steven M. Hansen, Kinston, N.C.

[73] Assignee: E. I. du Pont de Nemours and Company, Wilmington, Del.

[21] Appl. No.: 575,107

[22] Filed: Aug. 29, 1990

[51] Int. Cl.[5] ..... D01F 6/84

[52] U.S. Cl. ..... 264/103; 264/168; 264/210.7; 264/210.8; 264/211.15; 264/235.6; 264/346

[58] Field of Search ..... 264/210.7, 235.6, 211.14, 264/103, 168, 346, 210.8, 211.15

[56] References Cited

U.S. PATENT DOCUMENTS 2,071,251 2/1937 Carothers ..... 264/210.8
2,465,319 3/1949 Whinfield et al. ..... 264/210.8

*Primary Examiner*—Hubert C. Lorin

[57] ABSTRACT

Improved fibers of a copolymer of ethylene terephthalate/hexahydroterephthalate containing a high proportion of hexahydroterephthalate are obtained by a 2-stage drawing process, involving annealing, and crimping, with the annealing being performed within a temperature range of about 140° to about 175° C.

3 Claims, No Drawings

PROCESSING OF ETHYLENE TEREPHTHALATE/HEXAHYDROTEREPHTHALATE COPOLYMER FILAMENTS

FIELD OF INVENTION

This invention concerns improvements in the processing of filaments of a particular copolymer, namely an ethylene terephthalate/hexahydroterephthalate copolymer of 80–86 mol % terephthalic acid/20–14 mol % hexahydroterephthalic acid components, whereby such filaments are provided with improved properties, especially their load-bearing tenacity, and the resulting filaments, e.g., in the form of tows and staple fiber cut therefrom.

BACKGROUND OF THE INVENTION

Synthetic polymer fiber is used in textile fabrics, and for other purposes. For textile fabrics, there are essentially two main fiber categories, namely continuous filament yarns and staple fiber, i.e. cut fiber. Large amounts of filaments are used in small bundles of filaments, without cutting, i.e. as continuous filament yarn, e.g. in hosiery, lingerie and many silk-like fabrics based on continuous filament yarns; the present invention is not concerned with these continuous filament yarns, but with staple fiber and its precursor tow, which are prepared by very different equipment, and which require entirely different handling considerations because of the large numbers of filaments that are handled. Staple fiber has been made by melt-spinning synthetic polymer into filaments, collecting very large numbers of these filaments into a tow, which usually contains many thousands of filaments and is generally of the order of several hundred thousand in total denier, and then subjecting the continuous tow to a drawing operation between a set of feed rolls and a set of draw rolls (operating at a higher speed) to increase the orientation in the filaments, sometimes with an annealing operation to increase the crystallinity, and often followed by crimping the filaments, before converting the tow to staple fiber, e.g. in a staple cutter. One of the advantages of staple fibers is that they are readily blended, particularly with natural fibers, such as cotton (often referred to as short staple) and/or with other synthetic fibers, to achieve the advantages derivable from blending, and this blending may occur before the staple cutter, or at another stage, depending on process convenience.

It has been particularly desirable to blend synthetic staple fiber with cotton, particularly to improve the durability and economics of the fabrics made from the blends with cotton, because such synthetic staple fibers have a high load-bearing tenacity.

Synthetic polyester fibers have been known and used commercially for several decades, having been first suggested by W. H. Carothers, U.S. Pat. No. 2,071,251, and then by Whinfield and Dickson, U.S. Pat. No. 2,465,319. Most of the polyester polymer that has been manufactured and used commercially has been poly(ethylene terephthalate), sometimes referred to as 2G-T. This polymer is often referred to as homopolymer. Commercial homopolymer is notoriously difficult to dye. Such homopolymer is mostly dyed with disperse dyestuffs at high temperatures under elevated pressures, which is a relatively expensive and inconvenient process (in contrast to processes for dyeing several other commercial fibers at atmospheric pressure, e.g. at the boil), and so there have been several suggestions for improving the dyeability of polyester yarns. For instance, Griffing and Remington, U.S. Pat. No. 3,018,272, suggested the use of cationic-dyeable polyesters. Such polyesters, consisting essentially of poly [ethylene terephthalate/5-(sodium sulfo) isophthalate] containing about 2 mol % isophthalate groups in the polymer chain (2G-T/SSI), have been used commercially as a basis for polyester yarns for some 20 years.

Although such polyester fibers have been very useful, it has long been desirable to provide alternative fibers, having the desirable characteristics of commercial polyester fibers accompanied by excellent dyeing properties.

Watson, in U.S. Pat. No. 3,385,831, suggested textile fibers of copolymers of polyethylene terephthalate/hexahydroterephthalate. These fibers showed a surprising combination of enhanced dyeability and good overall physical properties, including low shrinkage values. These copolymer fibers are rather unique, considering the unusually large molar amounts of comonomer (i.e. the hexahydroterephthalate units, HT) in comparison with other comonomers in polymers with ethylene terephthalate (2G-T). Despite the advantages on paper, however, Watson's fibers were not produced in commercial quantities. Some reasons are believed to be the relatively low strength and relatively high sensitivity to elevated temperatures of Watson's fibers. As indicated, several properties do get less desirable as the proportion of comonomer is increased, although the dyeability is correspondingly improved. The improved dyeability from higher proportions of HT comonomer would have been very desirable, if such problems could have been solved.

An object of the present invention is to improve the properties of Watson's type of fibers of copolymers containing ethylene terephthalate (2G-T) and ethylene hexahydroterephthalate (2G-HT) units.

BRIEF SUMMARY OF THE INVENTION

According to one aspect of the invention, there is provided a process for preparing a tow of crimped filaments of ethylene terephthalate/hexahydroterephthalate copolymer of 80–86 mol percent terephthalic acid/20–14 mol percent hexahydroterephthalic acid components, said filaments having high load-bearing capacity, including the steps of melt-spinning said copolymer into filaments, forming a tow from a multiplicity of said filaments, and subjecting said tow to 2 stages of drawing, followed by annealing, and then crimping, wherein the annealing step is carried out by a hot roll annealing with the rolls heated to a temperature of 140°– 175° C. The filaments are preferably relaxed 2–10% as they are advanced during the annealing step.

According to another aspect of the invention, the resulting filaments and cut fibers are also provided.

DETAILED DESCRIPTION OF THE INVENTION

The particular copolymers and many of the details of their preparation and processing into fibers are described in Watson, U.S. Pat. No. 3,385,831, the disclosure of which is hereby specifically incorporated by reference. However, according to the present invention, it has proved possible to improve the properties of the fibers sufficiently so that the molar proportion may be as high as about 20 mol % of the hexahydroterephthalate(HT) comonomer component, i.e. about 12–20 mol % may be used, about 16–18% being preferred, especially about 17%. It is most unusual to find a satisfactory polymer of such high comonomer content, and much of the art prescribes that the amount should not exceed 15 mol%. Indeed, as indicated, as little as 2 mol % is used commercially for the 2G-T/SSI fiber.

Preferred drawing and annealing conditions for conventional polyester filaments have been disclosed in the art, e.g. Vail U.S. Pat. No. 3,816,486, the disclosure of which is also hereby specifically incorporated by reference. Generally, the apparatus described and illustrated by Vail may be used to practice the present invention, subject to the comments herein. In particular, Vail's recommendations about temperatures should be modified, as noted herein. However, it should be noted that it is surprising that any hot roll annealing process should give such advantageous results to fibers of high comonomer content such as are described by Watson, in view of the very high shrinkages disclosed. Indeed, the annealing stage of the process of the present invention must be carried out between critical temperature limits, as indicated in the Examples, herein after. A slightly higher roll temperature, such as 180° C., has been found to render the process inoperable, whereas too low a temperature does not provide significant improvement.

The invention is further illustrated in the following Examples, and contrasted with the process taught by Watson, in Example 4, column 6, of U.S. Pat. No. 3,385,831. The temperatures mentioned for the annealing heat treatment were the temperatures of the electrically heated rolls. The fiber properties were measured on filaments from the crimped tow for convenience.

EXAMPLE 1

A random copolymer of 17 mol % polyethylene hexahydroterephthalate and 83 mol % polyethylene terephthalate was prepared by ester exchange and polycondensation reactions to a fiber grade molecular weight (Relative Viscosity =20.5 LRV; IV =0.63). The polymer was melt-spun in a conventional manner using a spinneret temperature of 275° C. and was wound up at 1000 ypm to give a yarn having 1054 filaments and a total denier of 3150.

Bundles of yarn were collected together to form a tow of approximately 56250 filaments which were processed to staple fibers with two stages of drawing, followed by an annealing heat treatment under tension using electrically heated rolls, crimping, drying, and cutting. (By way of comparison, Watson used a single stage of drawing followed by heat treatment under tension in an oven with an air temperature of 180° C. for 24 seconds.)

The fibers were passed through a series of feed rolls, then through water at 45° C., to a first series of draw rolls maintained at a peripheral speed of 55 ypm to give a first stage draw ratio of 3.21×. This was followed by a second stage of drawing at a draw ratio of 1.22×to give a total draw ratio of 3.93X. The tow was then sprayed with water at 75° C. to cool the tow. We found that, when we tried to use 90° C. water in either the bath or spray, this gave excessive filament breakage and caused filaments to wrap on the rolls, and also resulted in an unacceptable level of dark-dyeing defects in the product fiber.

The cooled drawn tow was then passed to a series of electrically heated rolls which annealed the filaments by heating them under tension. During heat treatment under tension, a maximum operable roll temperature of 175° C. was determined. A temperature of 180° C. for the rolls rendered the process inoperable. Total residence time in the heat treatment process was 8 seconds. Fibers were allowed to relax 10% during the annealing process. At 1% relaxation level, the process gave inoperably high tensions in the tow band, resulting in high motor loads and broken filaments. A fiber finish was applied to the fibers which were crimped using a stuffer box crimper to a level of approximately 9 crimps per inch. Steam at 6 psi was introduced into the crimper during this stage. The crimped fibers were dried in an oven at 105° C. with a residence time of 8 minutes. The fibers were cut to staple.

The crimped filaments (and staple fiber) had a crystallinity index of approximately 30, a tenacity (T) of 6.6 gpd, a break elongation of 12%, an intermediate tenacity at 7% elongation (T7) of 3.4 gpd, an initial modulus of 60 gpd, a DHS (dry heat shrinkage at 160° C.) of about 10% and a shrinkage in boiling (BOS) water of 2.5%. Fibers produced according to the invention had, surprisingly, a higher tenacity than in Example 4 of Watson, although the new fibers were more highly modified (higher copolymer level of 17%), annealed with rolls at a lower temperature (175° C.) for a shorter time (24 seconds), and crimped, all of which would have been expected to lower the fiber tenacity.

The new fibers had better resistance to alkali hydrolysis, losing only approximately 0.2% per minute in 5% sodium hydroxide [compared to the 18 mol % fibers described by Watson which had a higher loss rate, approximately 0.3%, in a lower caustic concentration, 3% NaOH].

EXAMPLE 2

The random copolymer described in Example 1 was prepared at an increased molecular weight to a relative viscosity of 24 LRV (IV approximately 0.72). The polymer was spun in a conventional matter using a spinneret temperature of 285° C. and was wound up at 1450 ypm to give a yarn having 900 filaments and a total denier of approximately 2950.

Bundles of yarn were collected together forming a tow of approximately 45000 filaments which were drawn in two stages, heat-treated at 175° C. using electrically heated rolls, crimped, dried, and cut essentially as in Example 1 (except as indicated in Table 1). The physical properties of the fibers produced using this process are also given in Table 1.

TABLE 1

| Total DR | Anneal Temp (°C.) | DPF | T (GPD) | % E | BOS (%) | Shrink Ten (MGPD) | Density (G/CC) |
|---|---|---|---|---|---|---|---|
| 2.80 | 175 | 1.35 | 5.02 | 19.3 | 1.1 | 65 | 1.370 |
| 3.00 | 175 | 1.30 | 5.77 | 15.6 | 1.0 | 81 | 1.372 |
| 3.20 | 175 | 1.16 | 6.59 | 13.2 | 1.7 | 70 | 1.370 |

All these new fibers had a higher tenacity than those described by Watson. The relative disperse dye rate (RDDR) of the annealed fibers is approximately 6.5 times that of standard homopolymer.

EXAMPLE 3

A polymer with the same relative ratios of polyethylene hexahydroterephthalate and polyethylene terephthalate with the addition of 0.005 lb./lb. (of polymer) of tetraethyl silicate viscosity booster was made to a relative viscosity of approximately 16 LRV (IV approximately 0.57). The polymer was melt-spun in a conventional manner using a spinneret temperature of 275° C. and was wound up at 1200 ypm to give a yarn having 1054 filaments and a total denier of 5250.

Bundles of fibers were collected together forming a tow of approximately 42150 filaments which were drawn in two stages, heat-treated under constant tension, crimped, dried, and cut using the process, again, essentially as described in Example 1. The properties of the fibers resulting from this process are given in Table 2.

TABLE 2

| Total DR | Anneal Temp (°C.) | DPF | T (GPD) | $T_{10}$ (GPD) | % E | BOS (%) | RDDR (%) | Dye Rate |
|---|---|---|---|---|---|---|---|---|
| 3.87 | 170 | 1.42 | 3.45 | 2.3 | 19.0 | 2.2 | 432 | 0.212 |

The relative disperse dye uptake RDDR, (with carolid carrier) of the fiber produced by this process was compared to a standard polyethylene terephthalate control and was found to be 432 versus 100 for the control. The Dye Rate of the fiber was found to be 0.212 versus a rate of approximately 0.05 for a typical polyethylene terephthalate fiber.

EXAMPLE 4

The random copolymer described in Example 1 was prepared to a relative viscosity of 20.5 LRV (IV - 0.63). The polymer was melt-spun in a conventional manner using a spinneret temperature of 275° C. and was wound up at 1200 ypm to give a yarn having 1200 filaments and a denier of approximately 5250.

Bundles of yarn were collected together forming a tow which was drawn (as before) in two stages, heat-treated under constant tension, crimped, dried, and cut. The physical properties of fibers produced using this process are:

TABLE 3

| Total DR | Anneal Temp (°C.) | DPF | T (GPD) | $T_{10}$ (GPD) | % E | BOS (%) | RDDR % |
|---|---|---|---|---|---|---|---|
| 3.80 | 140 | 1.17 | 5.7 | 2.2 | 32.8 | 8.6 | 335 |
| 4.01 | 140 | 1.09 | 6.6 | 3.3 | 22.7 | 9.1 | 333 |
| 4.11 | 140 | 1.03 | 7.8 | 2.8 | 26.0 | 7.6 | 320 |
| 3.56 | 160 | 1.22 | 5.5 | 3.6 | 27.0 | 4.8 | 290 |
| 3.56 | 165 | 1.25 | 5.9 | 3.7 | 31.5 | 3.8 | 371 |
| 3.56 | 170 | 1.23 | 6.6 | 4.0 | 31.3 | 4.0 | 350 |
| 3.56 | 175 | 1.21 | 6.6 | 3.6 | 30.7 | 3.4 | 344 |

These results show (as expected) that fiber tenacity generally increased with draw ratio. At the same draw ratio, fiber tenacity increased with annealer temperature. We found that an annealer temperature of 180° C. resulted in fiber fusion, adhering to other fibers and process equipment. A reduction in annealer temperature gave lower $T_{10}$ and higher boil-off shrinkage values.

I claim:

1. Process for preparing a tow of crimped filaments of ethylene terephthalate/hexahydroterephthalate copolymer of 80–86 mol percent terephthalic acid/20–14 mol percent hexahydroterephthalic acid components, said filaments having high load-bearing capacity, including the steps of melt-spinning said copolymer into filaments, forming a tow from a multiplicity of said filaments, and subjecting said tow to 2 stages of drawing, followed by annealing, and then crimping, wherein the annealing step is carried out using rolls heated to a temperature of 140°–175° C.

2. Process according to claim 1, wherein the filaments are advanced and relaxed 2–10% during the annealing step.

3. Process according to claim 1 or 2, wherein said copolymer contains 16–18 mol % of hexahydroterephthalic acid components and 84–82 mol % of terephthalic acid components.

* * * * *